United States Patent [19]

Schranz et al.

[11] Patent Number: 4,810,628

[45] Date of Patent: Mar. 7, 1989

[54] COLOR PHOTOGRAPHIC RECORDING MATERIAL CAPABLE OF BEING DEVELOPED BY HEAT TREATMENT

[75] Inventors: Karl-Wilhelm Schranz, Odenthal-Hahnenberg; Günther Schenk, Cologne, both of Fed. Rep. of Germany

[73] Assignee: Agfa-Gevaert Aktiengesellschaft, Fed. Rep. of Germany

[21] Appl. No.: 896,406

[22] Filed: Aug. 13, 1986

[30] Foreign Application Priority Data

Aug. 23, 1985 [DE] Fed. Rep. of Germany ..... 3530156

[51] Int. Cl.[4] ..... G03C 1/04

[52] U.S. Cl. ..... 430/617; 430/284; 430/531

[58] Field of Search ..... 430/617, 284, 531

[56] References Cited

U.S. PATENT DOCUMENTS 4,036,650 7/1977 Hasegawa et al. ..... 430/619 X

*Primary Examiner*—J. David Welsh

*Attorney, Agent, or Firm*—Connolly & Hutz

[57] ABSTRACT

In a heat developable color photographic recording material containing, in a common layer of binder, a light-sensitive silver halide, optionally combined with a substantially light-sensitive silver salt, and a non-diffusible dye releasing compound, the binder of the said layer consists to an extent of at least 30% by weight of a polyurethane containing anionic groups. The recording material has a considerably increased sensitivity combined with improved $D_{min}/D_{max}$ relationship.

4 Claims, No Drawings

COLOR PHOTOGRAPHIC RECORDING MATERIAL CAPABLE OF BEING DEVELOPED BY HEAT TREATMENT

This invention relates to a heat developable colour photographic recording material having at least one layer of binder applied to a layer support, which layer of binder contains the light-sensitive silver halide and a non-diffusible colour providing compound and a synthetic polymer as binder.

It is known to produce colour images by heat treatment of suitable colour photographic recording materials. Colour providing compounds which are particularly suitable for this purpose are those which can be incorporated in the layer of a photographic recording material in a non-diffusible form and are capable of releasing a diffusible dye as a result of development (dye releasing compounds). The special suitability of such dye releasing compounds is based on the fact that the dyes which are released imagewise can be transferred to special image receptor layers to form a brilliant colour image which has no unwanted image silver or silver halide superimposed on it and therefore requires no after-treatment. An advantageous rapid process for the production of colour images can therefore be obtained by a combination of the heat development process with the dye diffusion process. A suitable recording material for this purpose has been described, for example, in DE-A-No. 3 215 485.

According to the said publication, a recording material having a layer containing a combination of silver halide, silver benzotriazole, a dye releasing compound and guanidine trichloroacetate (base donor) in a hydrophobic binder is exposed imagewise and then subjected to a heat treatment in contact with an image receptor sheet so that the dye which is released imagewise is transferred to the image receptor sheet. The production of multicolour images requires the use of several such combinations in which the silver halide of each combination is sensitive to a different spectral region of light and has a dye releasing compound associated with it corresponding to its spectral sensitivity, this dye releasing compound releasing a dye of a different colour, in most cases a colour which is complementary to the colour of the light to which the given silver halide is predominantly sensitive. Such associations may be arranged above one another in different layers.

The colour images obtained with the known colour photographic recording material which is developable by heat generally have fairly low maximum colour densities and high fog and the sensitivity of the material is also not entirely satisfactory.

It is therefore an object of the present Application to provide a heat developable colour photographic recording material which shows further improvements in the $D_{min}/D_{max}$ relationship and the sensitivity.

The present invention relates to a heat developable photographic recording material having at least one layer of binder applied to a layer support, which layer of binder contains light-sensitive silver halide, optionally combined with a substantially light-insensitive silver salt, and at least one non-diffusible colour providing compound capable of releasing a diffusible dye as a result of the development by heat treatment, characterised in that the binder of the said layer of binder consists to an extent of at least 30% by weight of a polyurethane containing anionic groups.

The colour photographic recording material carries, on a dimensionally stable layer support, at least one layer of binder containing, as its essential components, a light-sensitive silver halide, optionally in combination with a substantially light-insensitive silver salt. and a non-diffusible, colour providing compound capable of releasing a diffusible dye as a result of heat development.

The light-sensitive silver halide may consist of silver chloride, silver bromide, silver iodide or mixtures thereof and have a particle size of from 0.01 to 2.0 μm. preferably from 0.1 to 1.0 μm. It may be present in the form of a non-sensitized silver halide or it may be chemically sensitized, e.g. with compounds of sulphur, selenium or tellurium or with compounds of gold, platinum, palladium, rhodium or iridium or with reducing agents, e.g. a tin halide, or with a combination of these compounds. The silver halide may in addition be spectrally sensitized with known organic sensitizing dyes.

The quantity of light-sensitive silver halide in any given layer may be from 0.01 to 2.0 g per $m^2$ and may in some embodiments lie mainly at the lower end of this range owing to its catalytic function (as exposed silver halide).

The substantially light-insensitive silver salt may be, for example, a silver salt which is relatively stable to light, e.g. an organic silver salt. Suitable examples of such silver salts include the silver salts of aliphatic and aromatic carboxylic acids, the silver salts of heterocyclic compounds containing nitrogen, and the silver salts of organic mercapto compounds.

Preferred examples of silver salts of aliphatic carboxylic acids include silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate and silver butyrate. The carboxylic acids of these silver salts may be substituted, for example with halogen atoms, hydroxyl groups or thioether groups.

The following are examples of silver salts of aromatic carboxylic acids and of other compounds containing carboxyl groups: Silver benzoate, silver-3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenylacetate, silver pyromellitate, silver salts of 3-carboxymethyl-4-methyl-4-thiazoline-2-thione and similar heterocyclic compounds. Silver salts of organic mercaptans are also suitable, e.g. the silver salts or 3-mercapto-4-phenyl-1,2,4-triazole, 2-mercaptobenzimidazole, 2-mercaptobenzothiazole, 2-mercaptobenzoxazole, 2-mercaptooxadiazole, mercaptotriazine and thioglycolic acid, as well as the silver salts of dithiocarboxylic acids, e.g. the silver salt of dithioacetate.

Silver salts of compounds containing an imino group are also suitable. Preferred examples of such salts are the silver salts of benzotriazole and derivatives thereof, e.g. the silver salts of alkyl- and/or halogen-substituted benzotriazoles, e.g. of methylbenzotriazole or 5-chlorobenzotriazole and the silver salts of 1,2,4-triazole, 1-H-tetrazole, carbazole and saccharin and silver salts of imidazole, benzimidazole and derivatives thereof.

The quantity of substantially light-insensitive silver salt applied according to the invention is in the region of 0.05 to 5 g per $m^2$ in any given layer. The substantially light-insensitive silver salt and the light-sensitive silver halide may be present side by side as separate particles or they may be present in a combined form which may be produced, for example, by treating a substantially light-insensitive silver salt in the presence of halide ions so that light-sensitive centres of light-sensitive silver halide form on the surface of the particles of substantially light-insensitive silver salt by a process of double conversion. See in this respect U.S. Pat. No. 3,457,075.

The substantially light-insensitive silver salt serves as reservoir for metal ions which are reduced in the process of heat development to elementary silver under the catalytic influence of imagewise exposed silver halide in the presence of a reducing agent and themselves serve as oxidizing agent (for the reducing agent present).

The recording material according to the invention also contains, as essential component, at least one non-diffusible colour providing compound which is capable of releasing a diffusible dye as a result of a redox reaction taking place in the process of development. This colour providing compound will hereinafter be referred to as dye releasing compound or dye releaser.

The dye releasing compounds used according to the invention may belong to one of many types of compounds which are all distinguished by having a linking member which is redox dependent in the strength of its bond and links a dye residue to a carrier residue containing a ballast group.

A summarizing report of this subject is given in Angew. Chem. Int. Ed. Engl. 22 (1983), 191 - 209, in which the most important of the known systems are described.

Redox active dye releasing compounds corresponding to the formula

BALLAST - REDOX - DYE are particularly advantageous. In the above formula,

BALLAST denotes a ballast group,

REDOX denotes a redox active group, i.e. a group which is oxidizable or reducible under the conditions of alkaline development and which, depending upon whether it is in the oxidized or reduced state, is capable of being subjected to varying degrees to an elimination reaction, a nucleophilic displacement reaction or hydrolysis or some other decomposition reaction by which the DYE residue is split off, and DYE denotes the residue of a diffusible dye, e.g. of a yellow. magenta or cyan dye, or the residue of a dye precursor.

Ballast groups are groups which enable the dye releasing compounds according to the invention to be incorporated in a diffusion-fast form in the hydrophilic colloids conventionally used in photographic materials. Organic residues generally containing straight chained or branched aliphatic groups having generally 8 to 20 carbon atoms and optionally also carbocyclic or heterocyclic or possibly aromatic groups are particularly suitable for this purpose. These ballast groups may be attached to the remainder of the molecule either directly or indirectly, e.g. through one of the following groups: —NHCO—; —$NHSO_2$—; —NR— wherein R denotes hydrogen or alkyl; —O— or —S. The ballast group may in addition contain water-solubilizing groups such as sulpho groups or carboxyl groups which may also be present in an anionic form. Since the diffusion properties depend upon the molecular size of the whole compound used, it is sufficient in certain cases, e.g. when the whole molecule used is sufficiently large, to use shorter chain groups as ballast groups.

Redox active carrier groups having the structure of BALLAST-REDOX- and dye releasing compound are known in various forms. A detailed account need not be given here in view of the above-mentioned article in Angew. Chem. Int. Ed. Engl. 22 (1983) 191–209.

Some examples of redox-active carrier groups from which a dye residue is split off as a result of imagewise oxidation or reduction are shown below purely for the purpose of illustration:

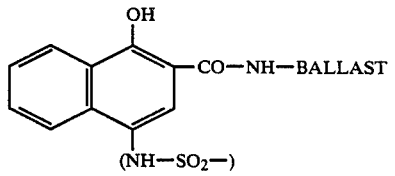

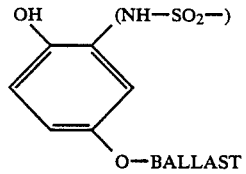

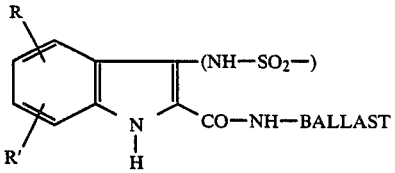

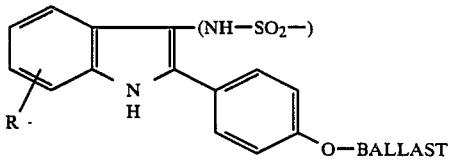

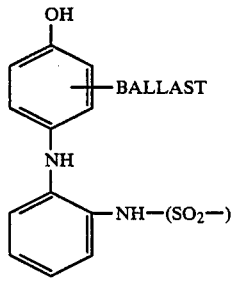

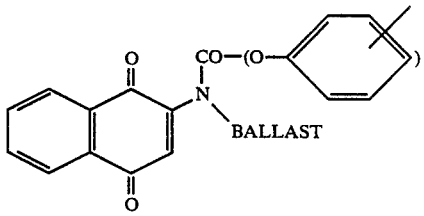

-continued

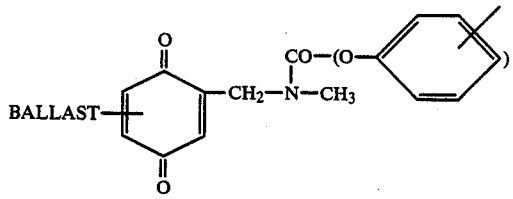

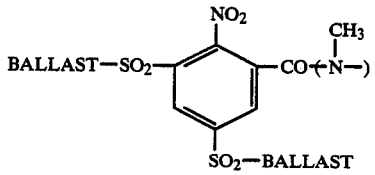

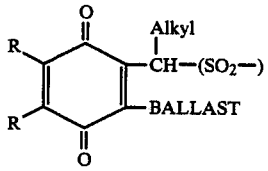

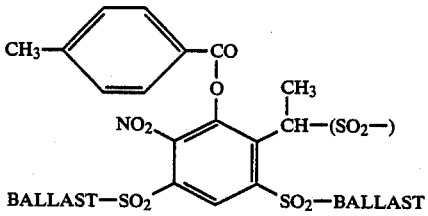

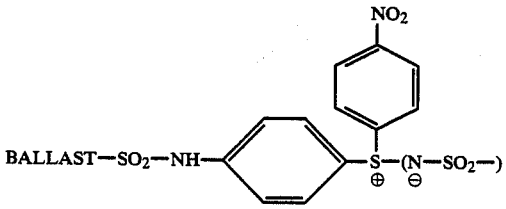

The groups in brackets are functional groups of the dye residue and are separated together with this residue from the remaining part of the carrier group. The functional group may be a substituent which may exert a direct influence on the absorption characteristics and possibly also complex forming characteristics of the released dye. On the other hand, the functional group may be separated from the chromophore of the dye by an intermediate or linking member. Furthermore, the functional group may be of some importance together with the intermediate member for determining the diffusion and mordanting characteristics of the released dye. Alkylene and arylene groups, for example, are suitable intermediate members.

Residues of dyes of any class of dyes may in principle serve as dye residues, provided they are sufficiently diffusible to diffuse from the light-sensitive layer of the light-sensitive material into an image receptor layer. The dye residues may be provided with one or more alkali solubilizing groups for this purpose. Suitable alkali solubilizing groups include inter alia carboxyl groups, sulpho groups, sulphonamide groups and aromatic hydroxyl groups. Such groups which confer solubility in alkalies may already be preformed in the dye releasing compounds or they may be produced as a result of separation of the dye residue from the carrier group which carries ballast groups. The following dyes are suitable: Azo dyes, azomethine dyes, anthraquinone dyes, phthalocyanine dyes, indigoid dyes and triphenylmethane dyes, including dyes which have undergone or are capable of undergoing complex formation with metal ions.

The residues of dye precursors are residues of compounds which are capable of being converted into dyes in the course of the photographic process, especially under the conditions of heat development, this conversion being effected by oxidation or by coupling, complex formation or the release of an auxochromic group in a chromophoric system, for example by saponification. Dye precursors within this meaning may be leuco dyes, couplers or dyes which are converted into other dyes in the course of processing. Where there is no essential difference between dye residues and residues of dye precursors, the term dye residue is to be understood in this context also to cover dye precursors.

Suitable dye releasing compounds are described, for example, in U.S. Pat. Nos. 3,227,500, 3,443,939, 3,443,940, DE-A-Nos. 1 930 215, 2 242 762, 2 402 900, 2 406 664, 2 505 248, 2 543 902, 2 613 005, 2 645 656, 2 809 716, 2 823 159, BE-A-No. 861 241, EP-A-Nos. 0 004 399, 0 004 400, DE-A-Nos. 3 008 588, 3 014 669 and GB-A-No. 8 012 242.

In some embodiments of the heat development process according to the invention, the dye releasing compound may be oxidizable or capable of coupling, whereas in others it may exist in a reducible form. When conventional negative silver halide emulsions are used, the copy obtained from the original will be either a negative or a positive copy, depending upon whether the dye has been released from the oxidized or the reduced form of dye releasing compound. It is therefore possible to obtain either positive or negative images as desired by suitable choice of the dye releasing system.

Oxidizable dye releasing compounds particularly suitable for the heat developable recording materials according to this invention are described, for example, in DE-A-No. 2 645 656.

If the dye releasing compound is oxidizable, it constitutes a reducing agent which is oxidized either directly or indirectly with the aid of electron transfer agents ETA by the imagewise exposed silver halide or by the substantially light-insensitive silver salt under the catalytic action of the imagewise exposed silver halide. The capacity to release diffusible dye is then differentiated imagewise. If, on the other hand, the dye releasing compound is reducible, then it is suitably used in combination with a limited quantity of reducing agent, a so-called electron donor compound or an electron donor precursor compound, which in this case is present in the same layer of binder as the dye releasing compound, the light-sensitive silver halide and, if indicated, the substantially light-insensitive silver salt. The presence of electron transfer agents may also be advantageous when reducing dye releasing compounds are used in combination with electron donor compounds.

For producing positive colour images from positive originals by means of negative silver halide emulsion it is suitable, for example, to use a recording material according to the invention containing reducible dye releasing compounds corresponding to the following formula:

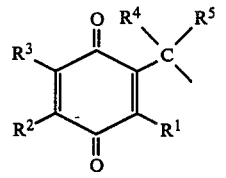

"Carquin"

wherein $R^1$ denotes alkyl or aryl, $R^2$ denotes alkyl, aryl or a group which combines with $R^3$ to form a condensed ring, $R^3$ denotes hydrogen, alkyl, aryl, hydroxyl, a halogen such as chlorine or bromine, amino, alkylamino, dialkylamino including cyclic amino groups (such as piperidino and morpholino), acylamino, alkylthio, alkoxy, aroxy, sulpho or a group which together with $R^2$ completes a condensed ring;

$R^4$ denotes alkyl, and $R^5$ denotes alkyl or, preferably, hydrogen, at least one of the groups $R^1$ to $R^4$ containing a ballast group.

The electron donor compound used in combination with a reducible dye releasing compound serves as reducing agent for the silver halide, the substantially light-insensitive silver salt and the dye releasing compound. Since the substantially light-insensitive silver salt and the dye releasing compound compete with each other in the oxidation of the electron donor compound but the former is always superior to the latter in this respect, at least in the presence of exposed silver halide, the image areas in which the dye releasing compound is converted into its reduced form by the electron donor compound will be determined by the silver halide present, which will depend on a previous imagewise exposure.

Under the conditions of development, in the present case when the imagewise exposed colour photographic recording material is heated, the electron donor compound which is present in a limited quantity will be oxidized by the substantially light-insensitive silver salt and the light-sensitive silver halide under the catalytic action of the latent image nuclei produced by exposure in the silver halide to an extent depending upon the degree of exposure and will therefore no longer be available for a reaction with the dye releasing compound. An imagewise distribution of unused electron donor compound is therefore obtained.

Compounds which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A-No. 2 809 716).

Other examples of electron donor compounds are disclosed in DE-A-Nos. 2 947 425, 3 006 268, 3 130 842, 3 144 037, 3 217 877 and EP-A-No. 0 124 915 and in Research Disclosure No. 24 305 (July 1984). It has been shown that the above-mentioned electron donor compounds will satisfy the requirements under the conditions of heat development and may therefore also be used as electron donor compounds for the purpose of the present invention. Particularly suitable are those electron donor compounds which are not present as such but formed from their precursor compounds under the conditions of heat development in the layer, i.e. electron donor compounds which prior to development are only present in a masked form in the recording material and as such virtually inactive. These initially inactive electron donor compounds are converted into their active form under the conditions of heat development, for example as a result of certain protective groups being split off hydrolytically. In the present case, such electron donor precursor compounds are also regarded as electron donor compounds.

The above mentioned essential components of the recording material used in the process according to the invention, namely the light-sensitive silver halide, the substantially light-insensitive, reducible silver salt optionally present and the dye releasing compound, optionally in combination with an electron donor compound, are present side by side in a common binder phase. According to the present invention, the binder consists to an extent of at least 30% by weight of a polyurethane containing anionic groups. The remainder of the binder (the amount required to make up 100%) consists predominantly of a conventional hydrophilic binder, in most cases of natural origin, in particular gelatine. For the purpose of the invention, it is preferred to use binder compositions consisting of mixtures of gelatine and a polyurethane containing anionic groups, this polyurethane being preferably present in a quantity of from 50 to 95% by weight, based on the total quantity of binder. On the other hand, the polyurethane may constitute the sole binder.

The casting solutions may be adjusted to a required viscosity by the addition of high molecular weight, water-soluble or water-insoluble compounds, so-called thickeners, for example in a quantity of up to 5% by weight, based on the total quantity of binder. The following are high molecular weight, water-soluble compounds of this kind: Polyvinyl pyrrolidone, polyvinyl methyl ether, polyvinyl alcohol, polyacrylic and methacrylic acid, polymaleic acid, polystyrene sulphonic acid, polyvinyl sulphonic acid and all copolymers of these compounds, naturally occurring substances such as gum arabic, dextrans, laevans and other soluble polysaccharides and derivatives thereof, provided they contain no cationic groups. Hydroxyethyl cellulose, for example, is particularly suitable.

Gelatine-compatible synthetic resin latices of polyacrylic acid esters and their copolymers and polyvinyl ethers and their copolymers are water-insoluble compounds which may be added. The compounds according to the invention may also advantageously be combined with dispersions of water-insoluble polyethers of the type described in GB-A-No. 1 053 568 or with dispersions of other water-insoluble compounds having a boiling point above 250° C.

The polyurethanes to be used according to the invention are distinguished in that they contain chemically built in hydrophilic groups, in particular anionic groups, preferably sulphate, sulphonate or carboxylate groups. Suitable polyurethanes include, for example, those containing at least 5 milliequivalents of anionic groups per 100 g of solid content, preferably 9 to 35 milliequivalents per 100 g of solid content.

The polyurethanes are generally obtained by a reaction (polyaddition) of polyisocyanates with compounds containing several reactive hydrogen atoms. The latter are subdivided into those which already have a certain molecular size, e.g. a molecular weight of at least 300, these compounds being in most cases precondensates such as polyesters, polyacetals, polyethers, polyamides or polyester amides, and those which have a lower molecular weight, the so-called chain lengthening agents. The reactive hydrogen atoms are generally present in hydroxyl, amino or carboxyl groups. Suitable starting materials for the preparation of polyurethanes include, for example, polyesters containing hydroxyl groups, in particular linear polyesters having two free hydroxyl groups in end positions.

Particularly suitable polyisocyanates are the diisocyanates, for example all aromatic and aliphatic diisocyanates, e.g. 1,5-naphthylene diisocyanate, 4,4'-diphenylmethane diisocyanate, 4,4'-diphenyldimethylmethane diisocyanate, di- and tetraalkyldiphenylmethane diisocyanate, 4,4'-dibenzyldiisocyanate, 1,3-phenylenediisocyanate, 1,4-phenylenediisocyanate, the isomers of tolylene diisocyanate, optionally as mixtures, and chlorinated and brominated diisocyanates, preferably aliphatic diisocyanates, butane-1,4-diisocyanate, hexane-1,6-diisocyanate, dicyclohexylmethane diisocyanate, cyclohexane-1,4-diisocyanate and prepolymers containing isocyanate groups.

Introduction of the anionic groups into the polyurethane molecule may be achieved by carrying out the polyaddition reaction leading to the polyurethane in the presence of compounds containing at least one active hydrogen and at least one anionic group or group capable of conversion into an anionic group. The last mentioned compounds are built into the polymer molecule by a reaction with a proportion of the isocyanate groups present. If the isocyanate groups present are not completely used up in the preparation of the polyurethanes, then introduction of the anionic groups by means of the above mentioned compounds may also be carried out after formation of the polyurethanes. If the polyurethane contains groups which can be alkylated or acylated, the subsequent introduction of the anionic or anionisable groups may be carried out in known manner by a reaction with compounds which contain an alkylating or acylating function and are capable of forming an anionic group in the course of the reaction. Compounds of this kind in most cases have a cyclic structure, and examples include dicarboxylic acid anhydrides, sultones, lactones, epoxycarboxylic acids and cyclic sulphates.

The polyaddition may be carried out, for example, in the presence of solvents, preferably low boiling solvents such as acetone, ethanol, methanol, tert.-butanol or methyl ethyl ketone, optionally together with a proportion of water. Water, optionally without the addition of organic solvent, may be used as solvent for inorganic bases and for compounds containing at least one isocyanate reactive hydrogen atom and at least one anionic group.

The resulting, predominantly linear, high molecular weight polyurethanes containing anionic groups may be converted into the aqueous phase by the addition of water and the organic solvents may be removed at the same time or subsequently. Dispersions are obtained in the form of latices or solutions. Processes for the preparation of suitable polyurethanes containing anionic groups are described, for example, in GB-A-No. 1 076 688, U.S. Pat. Nos. 3,479,310, 4,108,814, 4,092,286, DE-A-Nos. 2 725 589 and 2 811 148.

PU-1

Polyaddition product of 218.5 g of a polyester of adipic acid, hexanediol and neopentyl glycol (OH number 63) 55 g of 1,6-hexanediisocyanate and 27.8 g of sodium-1,2-diaminoethane-N-propane sulphonate.

PU-2

Polyaddition product of 218.5 g of a polyester of adipic acid, hexanediol and neopentyl glycol, 55 g of 1,6-hexane diisocyanate and 29.8 g of potassium-1,2-diaminoethane-N-propane sulphonate.

PU-3

Polyaddition product of 218.5 g of a polyester of adipic acid,hexanediol and neopentyl glycol, 30.6 g of 1,6-hexanediisocyanate and 31.9 g of a 20% aqueous sodium ethane sulphonate solution.

PU-4

Polyaddition product of 218.5 g of a polyester of adipic acid, hexanediol and neopentyl glycol, 45.5 g of 1,6-hexanediisocyanate and 138.0 g of a 20% aqueous solution of sodium amino ethane sulphonate.

PU-5

Polyaddition product of 218.5 g of a polyester of adipic acid, hexanediol and neopentyl glycol, 44.2 g of 1,6-hexane diisocyanate and 92.0 g of a 20% aqueous sodium amino ethane sulphonate solution.

PU-6

Polyaddition product of 218.5 g of a polyester of adipic acid, hexanediol and neopentyl glycol, 39.0 g of 1,6-hexanediisocyanate and 92.0 g of a 20% aqueous sodium aminoethane sulphonate solution.

PU-7

Polyaddition product of 218.5 g of a polyester of adipic acid, hexanediol and neopentyl glycol, 32.6 g of 1,6-hexanediisocyanate and 46 g of a 20% aqueous sodium aminoethane sulphonate solution.

PU-8

Polyaddition product of 218.5 g of a polyester of adipic acid, hexanediol and neopentyl glycol, 34.6 g of 1,6-hexanediisocyanate and 61.2 g of a 20% aqueous sodium aminoethane sulphonate solution.

PU-9

Polyaddition product of 218.5 g of a polyester of adipic acid, hexanediol and neopentyl glycol, 52.0 g of 1,6-hexanediisocyanate and 184.0 g of a 20% aqueous sodium amino ethane sulphonate solution.

PU-10

Polyaddition product of 218.5 g of a polyester of adipic acid, hexanediol and neopentyl glycol, 42.0 g of 1,6-hexane diisocyanate, 12.9 g of diethylene triamine, 12.5 g of succinic acid anhydride and 4.9 g of potassium hydroxide.

PU-11

Polyaddition product of 218.5 g of a polyester of adipic acid, hexanediol and neopentylglycol. 42.0 g of 1,6-hexane diisocyanate. 12.9 g of diethylene triamine, 12.5 g of succinic acid anhydride and 6.3 g of potassium hydroxide.

PU-12

Polyaddition product of 218.5 g of a polyester of adipic acid, hexanediol and neopentyl glycol, 38.0 g of 1,6-hexane diisocyanate and 14.9 g of potassium-1,2-diaminoethane-N-propanesulphonate.

PU-13

Polyaddition product of 218.5 g of a polyester of adipic acid, hexanediol and neopentyl glycol, 32.5 g of 1,6-hexane diisocyanate and 7.5 g of potassium-1,2-diamino ethane-N-propane sulphonate.

PU-14

Polyaddition product of 218.5 g of a polyester of adipic acid, hexanediol and neopentyl glycol, 36.7 g of 1,6-hexanediisocyanate and 11.2 g of potassium-1,2-diamino ethane-N-propane sulphonate.

PU-15

Polyaddition product of 106.3 g of a polyester of adipic acid, hexanediol and neopentyl glycol (OH number 65.85), 128.5 g of 1,6-hexane diisocyanate, 52.0 g of neopentyl glycol and 29.8 g of potassium-1,2-diaminoethane-N-propane sulphonate.

PU-16

Polyaddition product of 106.3 g of a polyester of adipic acid. hexanediol and neopentyl glycol (OH number 65.85), 250.0 g of 1,6-hexane diisocyanate, 53.0 g of diethylene glycol, 52.0 g of neopentyl glycol and 29.8 g of potassium-1,2-diaminoethane-N-propanesulphonate.

PU-17

Polyaddition product of 106.3 g of a polyester of adipic acid, hexanediol and neopentyl glycol (0H number 65.85), 121.0 g of 1,6-hexanediisocyanate, 26.5 g of diethylene glycol, 26.0 g of neopentyl glycol and 29.8 g of potassium-1,2-diaminoethane-N-propane sulphonate.

PU-18

Polyaddition product of 212.5 g of a polyester of adipic acid, hexanediol and neopentyl glycol (0H number 65.85), 89.0 g of 1,6-hexanediisocyanate and 59.6 g of potassium-1,2-diaminoethane-N-propane sulphonate.

PU-19

Polyaddition product of 212.5 g of a polyester of adipic acid, hexanediol and neopentyl glycol (0H number 65.85), 72.0 g of 1,6-hexanediisocyanate and 44.7 g of potassium-1,2-diaminoethane-N-propanesulphonate.

PU-20

Polyaddition product of 250.0 g of polypropylene glycol (OH number 56), 48.0 g of 1,6-hexanediisocyanate and 29.8 g of potassium-1,2-diaminoethane-N-propanesulphonate.

In addition to containing the essential components already mentioned above, the colour photographic recording material may contain other components and auxiliary substances suitable, for example, for promoting the heat treatment and resulting colour transfer. These other components and auxiliary substances may be contained in a light-sensitive layer or in a light-insensitive layer.

Auxiliary developers are examples of such auxiliary substances. These auxiliary developers generally have the property of developing exposed silver halide. In the present case they mainly promote the reactions between the exposed silver salt (silver salt in the presence of exposed silver halide) and the reducing agent, the latter being identical to the dye releasing compound if an oxidizable dye releasing compound is used but reacting with the dye releasing compound if a reducible dye releasing compound is used. Since these reactions consist mainly in a transfer of electrons, the auxiliary developers are also referred to as electron transfer agents ETA.

Examples of suitable auxiliary developers include hydroquinone, pyrocatechol, pyrogallol, hydroxylamine, ascorbic acid, 1-phenyl-3-pyrazolinone and derivatives thereof. Since the auxiliary developers at the same time perform a catalytic function, they need not be present in stoichiometric quantities. It is generally sufficient if the layer contains up to ½ mol of auxiliary developer per mol of dye releasing compound. The auxiliary developer may be incorporated in the layer, for example from solutions in water-soluble solvents or in the form of aqueous dispersions obtained with the aid of oil formers.

Basic substances or compounds capable of giving rise to basic substances under the influence of the heat treatment may also serve as auxiliary substances. Examples of such compounds include sodium hydroxide, potassium hydroxide, calcium hydroxide, sodium carbonate, sodium acetate and organic bases, in particular amines such as trialkylamines, hydroxyalkylamines, piperidine, morpholine, dialkylaniline, p-toluidine, 2-picoline, guanidine and salts thereof, in particular salts with aliphatic carboxylic acids, e.g. trichloroacetates. The basic substance provide a suitable alkaline medium in the light-sensitive layer and adjacent layers during the heat treatment to ensure that the diffusible dyes will be released from the dye releasing compounds and diffuse into the image receptor layer.

Compounds capable of releasing water under the action of heat may also serve as auxiliary substances, in particular inorganic salts containing water of crystallisation, e.g. $Na_2SO_4.10H_2O$, $NH_4Fe(SO_4)_2.12H_2O$ and the type of sodium benzotriazolate which crystallise as complexes with varying quantities of water (up to 24 mol $H_2O$). These compounds have been described in U.S. Pat. No. 4,418,139

The water released on heating promotes the development and diffusion processes required for production of the image.

Other auxiliary substances include, for example, the so-called thermal solvents or development and diffusion promoting agents. These are generally non-hydrolysable organic compounds which are solid or liquid under normal conditions and capable at the temperature of the heat treatment of providing a liquid medium in which the development and diffusion processes can take place more rapidly. Preferred examples include polyglycols as described, for example, in U.S. Pat. No. 3,347,675, e.g. polyethylene glycol having an average molecular weight of from 1500 to 20,000. derivatives of polyethylene oxide such as its oleic acid esters. beeswax, monostearin, compounds having a high dielectric constant and containing a $SO_2$ or CO group, such as acetamide, lactams, succinamide, ethyl carbamate, urea, methyl sulphonamide or ethylene carbonate; also polar substances as described in U.S. Pat. No. 3,667,959, the lactone of 4-hydroxybutyric acid, dimetnylsulphoxide, tetrahydrothiophene-1,1-dioxide, 1,10-decanediol, methyl anisate, biphenyl suberate, etc. as well as water, ethylene glycol, glycerol and other readily solubilizing solvents.

Development of the imagewise exposed colour photographic recording material according to the invention covers the steps of silver halide development, production of an imagewise distribution of diffusible dyes and transfer of this imagewise distribution into the image receptor layer by diffusion. Development is initiated by subjecting the exposed recording material to a heat treatment in which the light-sensitive layer of binder is heated to a temperature e.g. in the region of 80° to 250° C. for a period of about 0.5 to 300 seconds. Suitable conditions are thereby created in the recording material for the development processes, including dye diffusion, without the addition of a liquid medium, e.g. in the form of a developer bath. Diffusible dyes are released imagewise from the dye releasing compounds in the course of development and transferred to an image receptor layer which is either an integral part of the colour photographic recording material according to the invention or in close contact with this material at least during the time of development.

Imagewise development of silver, release of dye and transfer of dye thus take place synchronously in a single-step development process.

The production of colour with the colour photographic recording material according to the invention may also take place by a two-step development process in which silver halide development and release of dye take place in a first step and transfer of colour image from the light-sensitive part to an image receptor part in contact therewith takes place in a second step, e.g by heating to a temperature of from 50° to 150° C., preferably from 70° to 90° C., in which case diffusion auxiliaries (solvents) may be supplied externally before lamination of the light-sensitive part with the image receptor part.

The image receptor layer may thus be arranged on the same layer support as the light-sensitive element (single sheet material) or it may be arranged on a separate layer support (two sheet material). It consists substantially of a binder containing mordant for fixing the diffusible dyes released from the non-diffusible dye releasing compounds. The mordants used for anionic dyes are preferably long-chained quaternary ammonium or phosphonium compounds, e.g. of the kind described in U.S. Pat. Nos. 3,271,147 and 3,271,148.

Certain metal salts and their hydroxides forming sparingly soluble compounds with the acid dyes may also be used. Polymeric mordants of the kind described in DE-A-Nos. 2 315 304, 2 631 521 or 2 941 818 may also be used. The dye mordants in the layer of mordant are dispersed in one of the usual hydrophilic binders, e.g. in gelatine, polyvinyl pyrrolidone or partially or completely hydrolysed cellulose ester. Some binders may, of course, double as mordants, e.g. polymers of nitrogen-containing, optionally quaternary bases such as N-methyl-4-vinylpyridine, 4-vinylpyridine or 1-vinyl imidazole, as described, for example, in U.S. Pat. No. 2,484,430. Further examples of suitable mordanting binders include guanyl hydrazone derivatives of alkyl vinyl ketone polymers as described, for example, in U.S. Pat. No. 2,882,156 and guanyl hydrazone derivatives of acyl styrene polymers as described, for example, in DE-A-No. 2 009 498. The last mentioned mordanting binders, however, would generally be used with the addition of other binders, e.g. gelatine.

If the image receptor layer is to be left in contact with the light-sensitive element after development has been completed, the two layers are generally separated by an alkali permeable, light-reflecting layer of binder containing pigment to ensure optical separation between the negative and positive images and serve as aesthetically pleasing background for the transferred positive colour image. If the layer of binder is arranged between the layer support and the light-sensitive element and is separated from the latter by a previously formed light-reflecting layer, then the layer support must either be transparent so that the transferred colour image can be viewed through it or the light-sensitive element must be removed from the image receptor layer together with the light-reflecting layer in order to expose the image receptor layer. However, the image receptor layer may be arranged as uppermost layer in an integral colour photographic recording material, in which case the material may suitably be exposed through the transparent layer support.

EXAMPLE 1

Preparation of the silver salt emulsion

Emulsion 1

17.0 g of $AgNO_3$ dissolved in 200 ml of water at 45° C. were added with stirring in the course of 2 minutes to a solution heated to 45° C. of 20.0 g of gelatine in 1000 ml of water containing 13.0 g of benzotriazole (BTA). Stirring was then continued for 5 minutes. The pH was adjusted to 5.0 with a 5% $Na_2CO_3$ solution. The reaction mixture was flocculated by the addition of 20 ml of a 10% polystyrene sulphonic acid solution, cooling to 25° C. and addition of 10% sulphuric acid (up to pH 3.0–3.5) and then washed three times, each time with 1000 ml of water. The flocculate was heated to 45° C. and adjusted to pH 6.0 with 5% $Na_2CO_3$ solution. 5 ml of 1% aqueous phenol solution was added and the reaction mixture made up to a final weight of 435 g by the addition of water.

Emulsion 2

34.0 g of $AgNO_3$ dissolved in 200 ml of water were added to a solution, heated to 50° C., of 40.0 g of gelatine, 23.7 g of KBr and 1.66 g of KI within 10 minutes. Stirring was then continued for 20 minutes at 50° C. and the reaction mixture was then cooled to 35° C. 40 ml of a 10% polystyrene sulphonic acid solution were added dropwise and the mixture was then cooled to 20° C. Flocculation was carried out by the addition of 10% sulphuric acid (up to pH 3.0–3.5) and the flocculate washed three times with 700 ml portions of water. The reaction mixture was then heated to 40° C. and adjusted to pH 6.0 with 10% sodium hydroxide solution. Final weight 1171 g.

For spectral sensitization, parts of Emulsion 2 (crude emulsion) were melted 40° C., and $4\times10^{-4}$ mol of red or green sensitizer or $8\times10^{-4}$ mol of blue sensitizer was added per mol of Ag in each case as a methanolic solution or suspension, and left to digest in a closed vessel for about 70 minutes.

The following spectral sensitizers were used.

Red sensitizer

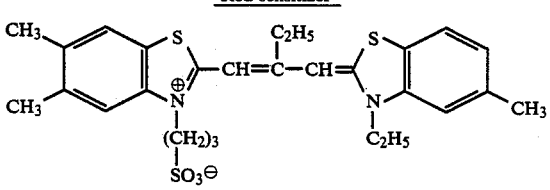

Green sensitizer

-continued

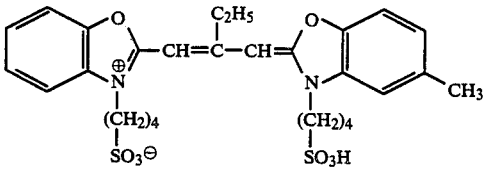

Blue sensitizer

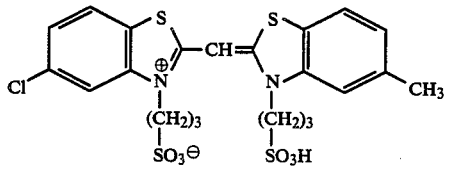

EXAMPLE 2

Preparation of the dispersion

Dispersion 1 (Dye releasing compound C-1)

50 go of Dye releasing compound C-1 were dissolved in a mixture of 50 g of tricresyl phosphate, 50 g of tetrahydrofuran and 200 ml of ethyl acetate with 50 g of a 20% aqueous solution of $KHCO_3$ and dispersed in 330 g of a 10% aqueous gelatine solution in the presence of 2.6 g of sodium dodecylbenzene sulphonate, and the auxiliary solvents were then evaporated off with depressurized water vapour in a vacuum apparatus. Yield: 957 g of Dispersion 1.

Dispersion 2 (Dye releasing compound M-1)

50 g of Dye releasing compound M-1 were dissolved in 25 g of diethyl laurylamide and 150 ml of ethyl acetate and then treated by the same method as Dispersion 1. Yield: 834 g of Dispersion 2.

Dispersion 3 (Dye releasing compound M-2)

31 g of Dye releasing compound M-2 where dissolved in 15.5 g of diethyl laurylamide with 100 ml of ethyl acetate, dispersed in 205 g of 10% aqueous gelatine solution in the presence of 1.55 g of sodium dodecylbenzene sulphonate and then treated by the same method as Dispersion 1. Yield: 1028 g of Dispersion 3.

Dispersion 4 (Dye releasing compound Y-1)

50 g of Dye releasing compound Y-1 were dissolved in 25 g of diethyl laurylamide and 150 ml of ethyl acetate and then treated by the same method as Dispersion 1. Yield: 821 g of Dispersion 4.

Dispersion 5 (Auxiliary developer precursor compound)

62 g of Auxiliary developer precursor compound were dissolved in 120 g of diethyl laurylamide and 150 ml of ethyl acetate and dispersed in 612 g of 10% aqueous gelatine solution in the presence of 3.5 g of sodium dodecylbenzene sulphonate. The auxiliary solvent was then removed by the same method as that used for Dispersion 1. Yield: 997 g of Dispersion 5.

The following compounds were used:

Dye releasing compound C-1

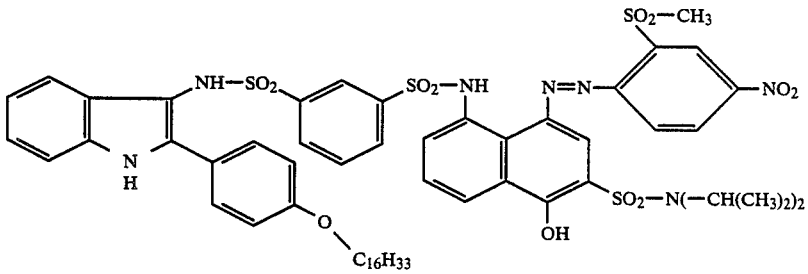

Dye releasing compound M-1

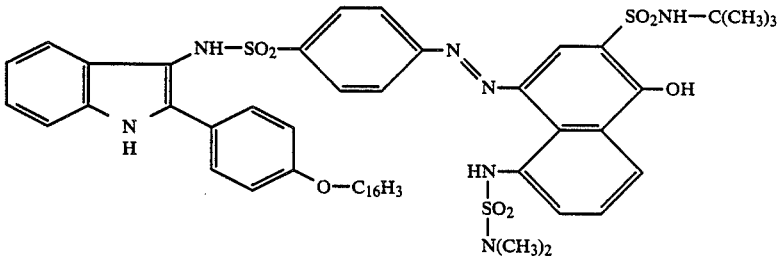

Dye releasing compound M-2

-continued

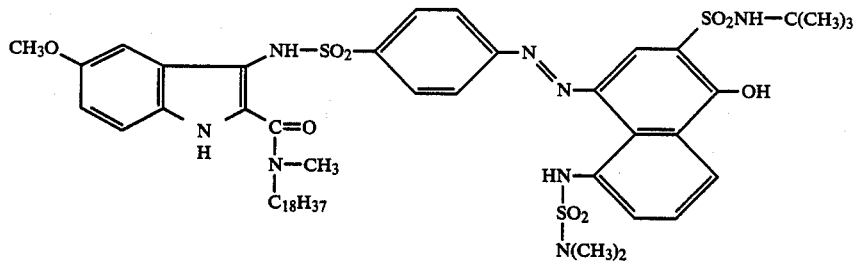

Dye releasing compound Y-1

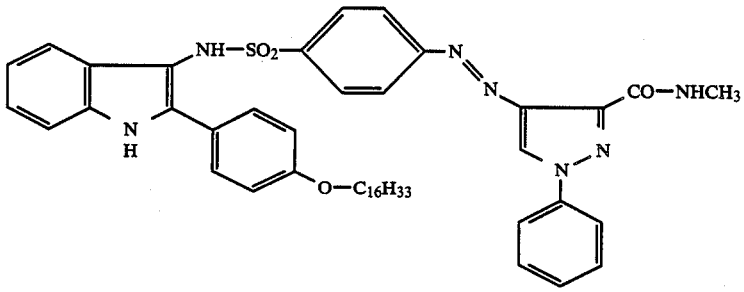

Auxiliary developer precursor compound

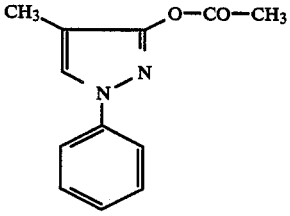

EXAMPLE 3

The image receptor part of a photographic recording material for the dye diffusion transfer process was prepared by applying the following layers in succession to a transparent layer support of polyethylene terephthalate. The quantities given are based in each case on 1 $m^2$.

1. A light-reflecting layer containing 20 g of $TiO_2$ and 2 g of gelatine.
2. A mordant layer containing 2 go of polyurethane mordant of 4,4'-diphenylmethane diisocyanate and N-ethyldiethanolaime quarternized with epichlorohydrin according to the DE-A-No. 2 631 521, Example 1, and 2 g of gelatine.
3. A protective layer of 1 g of gelatine (hardener is applied with this protective layer).

The $TiO_2$ layer may be omitted if baryta paper is used as layer support.

EXAMPLE 4

The light-sensitive parts of colour photographic recording materials not according to the invention (comparison) and according to the invention for the dye diffusion transfer process were prepared as follows:

SAMPLE 1

32.0 g of Emulsion 2, red sensitive, and 45.6 g of Emulsion 1 were melted at 40° C. and 8 ml of a 4% aqueous solution of Triton [R]×100 were added.

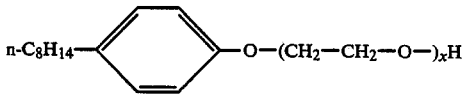

x = 9 to 10

Triton X 100
Manufacturers: Rohm and Haas Company, Philadelphia 18.5 g of Dispersion 1 (Dye releasing compound C-1), 6.7 g of Dispersion 5 (auxiliary developer precursor compound) and 66 g of 20% gelatine were then added and the mixture was melted. 150 mg of mercury-II chloride dissolved in 30 ml of water and 3.2 g of guanidine trichloroacetate in 30 ml of water were added and the mixture was made up with water to a final weight of 320 g. The solution was applied in a wet thickness of 100 μm to a layer support of polyethylene terephthalate, coated with a 1% of aqueous gelatine solution containing a hardener (wet layer thickness 40 μm) and dried.

SAMPLE 2

The method of preparation was the same as for Sample 1 but using 32.0 go of Emulsion 2, green sensitized, and 17.2 g of Dispersion 2 (Dye releasing compound M-1).

SAMPLE 3

The method of preparation was the same as for Sample 1 but using 32.0 g of Emulsion 2, blue sensitized, and 15.3 g of Dispersion 4 (Dye releasing compound Y-1).

Samples 1 to 3, which are recording materials not according to the invention, were tested with the other samples for comparison. The binder consisted entirely of gelatine. The method of preparation of the recording materials according to the invention is described below (Samples 4 to 7). The polyurethane used was a 30% aqueous dispersion of an anionic polyester polyurethane free from wetting agent and obtained from 84.1% of a polyester of adipic acid, 1,6-hexanediol and neopentyl glycol (molar ratio 30:22:12) OH number 66.6, molecular weight 1600 to 1700,
13.1% of hexamethylene diisocyanate and
2.7% of N-aminoethyl taurine.
Amount of $SO_3Na$ groups present 1.93%.

SAMPLE 4

24.0 g of a 2.5% aqueous solution of natrosol were homogenized with 108 ml of water and 8 ml of a 4% aqueous solution of Triton[R]×100. 6.7 g of Dispersion 5, 18.5 g of Dispersion 1 (Dye releasing compound C-1), 45.6 g of Emulsion 1 and 32.0 g of Emulsion 2, red sensitized, were added and the mixture was melted. 3.2 g of guanidine trichloroacetate in 30 m 1 of water were then slowly added, followed by 44.0 g of the above described 30% polyurethane solution, and the whole mixture was then homogenized. The prepared casting solution was applied to a layer support of polyethylene terephthalate to form a layer having a thickness of 100 μm when wet and the layer was dried at 35° C. This layer was covered with a 1% aqueous gelatine solution containing a hardener (wet layer thickness 40 μm) and dried.

SAMPLE 5

Method of preparation the same as for Sample 4 but using 32.0 g of Emulsion 2, green sensitized, and 17.2 g of Dispersion 2 (dye releasing compound M-1).

SAMPLE 6

Method of preparation same as for Sample 4 but using 32.0 g of Emulsion 2, blue sensitized, and 15.3 g of Dispersion 4 (dye releasing compound Y-1).

SAMPLE 7

Method of preparation same as for Sample 4 but using 89 ml of water to homogenize the natrosol solution (instead of 108 ml) as well as 32.0 g of Emulsion 2, green sensitized, and 37.8 g of Dispersion 3 (dye releasing compound M-2).

EXAMPLE 5

The samples prepared according to Example 4 were exposed to a tungsten lamp with interposition, in the case of samples 1, 2, 4, 5 and 7, of a transparent yellow filter having a density of 1.25. The intensity and time of exposure are shown in Table 1. The samples were then heated to 110° C. in the dry state for development. The duration of this treatment is also shown in Table 1. The samples were then left to swell in water for 10 seconds and laminated to an image receptor sheet (from Example 3) which had been left to swell in water for 30 seconds, and the laminate was heated to 75° C. on a controlled heating bench for 2 minutes, and the two layers were then separated and immediately dried. Sharp, brilliant colour transfers obtained on the image receptor sheets. The $D_{min}$ and $D_{max}$ values are also entered in Table 1.

Table 1 shows that a sharp reduction in development time and marked improvement in the sensitivity by a factor of about f=80 are obtained in the recording materials according to the invention. In addition, the fog values $D_{min}$ are greatly reduced and $D_{max}$ values are improved at the same time. When the mercury-II chloride used as stabilizer is omitted from the comparison samples, only colour fogs are obtained and virtually no discrimination between $D_{min}$ and $D_{max}$.

TABLE 1

| Sample | Intensity of exposure (Lux) | Exposure time [s] | Development time [s] | Colour Density $D_{min}$ | Colour Density $D_{max}$ |
|---|---|---|---|---|---|
| 1 | 20 000 | 20 | 480 | 0.42 | 1.55 |
| 2 | 20 000 | 20 | 480 | 0.38 | 1.37 |
| 3 | 20 000 | 20 | 480 | 0.30 | 1.23 |
| 4 | 1 000 | 5 | 60 | 0.21 | 1.85 |
| 5 | 1 000 | 5 | 60 | 0.19 | 1.79 |
| 6 | 1 000 | 5 | 60 | 0.17 | 1.60 |
| 7 | 1 000 | 5 | 60 | 0.20 | 1.61 |

EXAMPLE 6

Integral recording materials consisting of light-sensitive part and image receptor part for the dye diffusion transfer process were prepared by applying the layer casting solutions described below to a layer support of polyethylene terephthalate.

SAMPLE 8

1. 9 g of guanidine trichloroacetate in 60 ml of water and 6 ml of a 4% aqueous solution of Triton[R]×100 were added to 165 ml of water at 40° C. and the mixture was melted together with 60 g of 20% gelatine. Thickness of wet layer 50 μm.
2. 1.5% aqueous gelatine solution containing hardener. Thickness of wet layer 40 μm.
3. Casting solution as for sample 4 but without guanidine trichloroacetate. Thickness of wet layer 100 μm (drying at 35° C.).
4. Same as layer 2.
5. Dispersion of 50 g of $TiO_2$ in 250 g of a 2% aqueous gelatine solution. Thickness of wet layer 60 μm.
6. Casting solution as for mordant layer in Example 3. Wet layer thickness 70 μm.
7. Same as layer 2 but wet layer thickness 60 μm.

SAMPLE 9

Method of preparation same as for Sample 8 but layer 3 was prepared from the same casting solution as that used for Sample 5 but without guanidine trichloroacetate.

SAMPLE 10

Method of preparation same as for Sample 8 but the casting solution for Layer 3 was the same as that used in Example 6 but without guanidine trichloroacetate.

Samples 8, 9 and 10 were exposed to a 1000 Lux tungsten lamp through the transparent support for 10 seconds. Samples 8 and 9 were exposed behind a transparent yellow filter of density 1.25. The samples were then developed dry at 110° C. on a heating bench for 60 seconds and samples 8, 9 and 10 were exposed after this dry development to a water vapour atmosphere at 75° C. for 4 minutes. The samples were then briefly dried at room temperature. The $D_{min}$ and $D_{max}$ values obtained are shown in Table 2. This variation of the process requires no processing baths but only the supply of heat and then water vapour, for example at 75° C. Alternatively, the second step of the treatment may consist of swelling the recording material (developed dry) in water and then heating it, for example on a heating bench to 75° C.

TABLE 2

| Sample | Colour density $D_{min}$ | $D_{max}$ |
|---|---|---|
| 8 | 0.23 | 1.64 |
| 9 | 0.21 | 1.53 |
| 10 | 0.19 | 1.35 |

We claim:

1. Heat developable colour photographic recording material having at least one layer of binder applied to a layer support and containing light-sensitive silver halide, optionally combined with a substantially light-insensitive silver slat, and at least one non-diffusible, colour providing compound capable of releasing a diffusible dye as a result of development by heat treatment, wherein the binder of the said layer of binder consists to an extent of at least 30% by weight of a polyurethane containing anionic groups.

2. Recording material as claimed in claim 1 wherein the binder of the above-mentioned layer of binder consists to an extend of 50 to 95% by weight of a polyurethane containing anionic groups, 5 to 50% by weight of a hydrophilic binder and optionally 0 to 5% by weight of a thickener.

3. Recording material as claimed in claim 2 wherein the hydrophilic binder consists of gelatine.

4. Recording material as claimed in claims 1, 2 or 3 wherein the polyurethane contains at least 5 milliequivalents of anionic groups per 100 g of solid.

* * * * *